United States Patent [19]

Simpson

[11] Patent Number: 4,617,866

[45] Date of Patent: Oct. 21, 1986

[54] PYROTECHNIC OR EXPLOSIVE DEVICE

[75] Inventor: Geoffrey M. Simpson, Bulwell, United Kingdom

[73] Assignee: Haley & Weller Limited, Derbyshire, United Kingdom

[21] Appl. No.: 610,706

[22] Filed: May 16, 1984

[30] Foreign Application Priority Data

May 18, 1983 [GB] United Kingdom ..... 8313572
May 9, 1984 [EP] European Pat. Off. ..... 84303116.2

[51] Int. Cl.[4] ..... F42C 19/06; F42C 11/06

[52] U.S. Cl. ..... 102/262; 102/206; 102/487

[58] Field of Search ..... 102/206, 487, 368, 254, 102/256, 262, 275.11, 218

[56] References Cited

U.S. PATENT DOCUMENTS

| | | | |
|---|---|---|---|
| 3,101,055 | 8/1963 | Kuntz et al. | 102/262 |
| 3,636,878 | 1/1972 | Fay | 102/487 |
| 3,712,218 | 1/1973 | Fay | 102/487 |
| 4,041,865 | 8/1977 | Evans et al. | 102/206 |

FOREIGN PATENT DOCUMENTS

| | | |
|---|---|---|
| 1292384 | 3/1962 | France . |
| 2015366 | 4/1970 | France . |
| 2116783 | 7/1972 | France . |
| 2339155 | 8/1977 | France . |
| 2483068 | 11/1981 | France . |

*Primary Examiner*—Charles T. Jordan
*Attorney, Agent, or Firm*—William R. Hinds

[57] ABSTRACT

A pyrotechnic or explosive device comprises a pyrotechnic or explosive charge and an electrical firing circuit therefor. The firing circuit includes a source of electrical energy, an electrical firing element to ignite the charge, and an electric switch connected between the energy source and the firing element. The switch includes biasing means and manually engageable means for holding the switch open against the biasing means. Delay means, either pyrotechnic or electrical, are preferably included.

4 Claims, 6 Drawing Figures

PYROTECHNIC OR EXPLOSIVE DEVICE

This invention relates to a pyrotechnic or explosive device and is especially, but not exclusively, applicable to a hand-propelled device such as a hand grenade.

A wide range of pyrotechnic and explosive devices, including smoke signals, flares, smoke screening grenades, irritant smoke and gas grenades and illuminating rockets, is used by military personnel. Many of these are required to be used in conditions where the noise produced by operating the initiating mechanism is disadvantageous or even dangerous. For example, the "fly-off" handle of a hand grenade, percussion caps and spring-loaded trigger mechanisms, all produce distinctive noises which could give a warning to an adversary or even indicate the position of the person projecting the device.

The present invention provides a pyrotechnic or explosive device comprising a pyrotechnic or explosive charge and an electrical firing circuit therefor, the circuit including a source of electrical energy, for example an electric cell or battery, an electrical firing element to ignite the charge, and a hand-operable electric switch connected between the energy source and the firing element.

The firing element may simply comprise an electric igniter, the circuit then preferably including a delay element, for example a timing circuit, to operate the igniter at a predetermined delay after operation of the switch. The timing circuit may include an adjustable element whereby the delay may be varied by the user according, for example, to the range of projection of the device. Alternatively, a pyrotechnic delay can be incorporated in the charge, initiated by the firing element.

The switch is preferably operatively coupled to a spring-biased handle, release of which closes the switch to initiate firing of the charge. The handle may be locked into a safe position in the manner conventional for hand-thrown grenades using a pin which has to be removed before the handle can be released to fire the charge.

Reference is made to the drawings, which show, a hand-propelled grenade as an exemplary embodiment of the invention, and in which.

Figure 1:
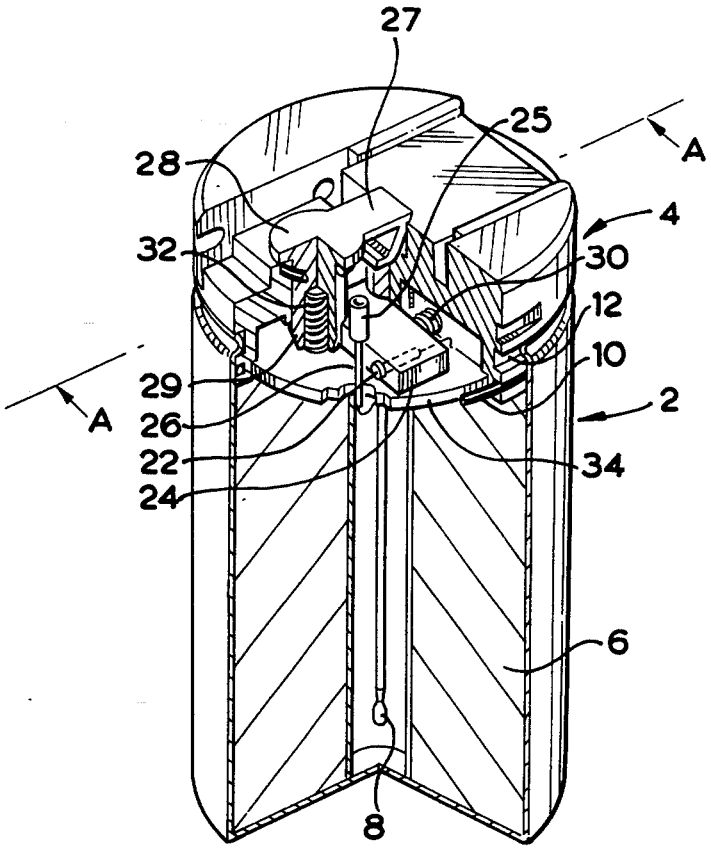
FIG. 1 is a perspective view, partially cut-away, of the grenade.
Figure 2:
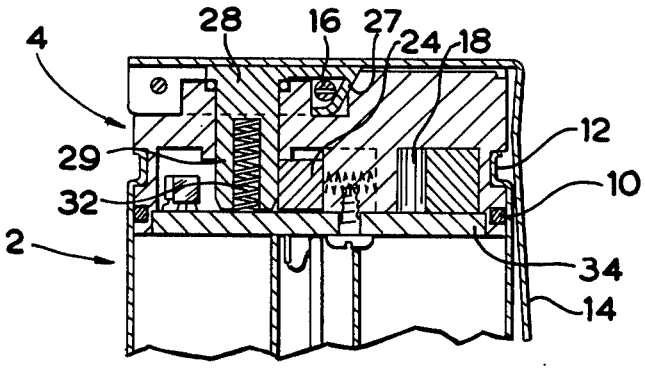
FIG. 2 is a section on line A—A in FIG. 1 of the head-piece of the grenade.
Figure 3:
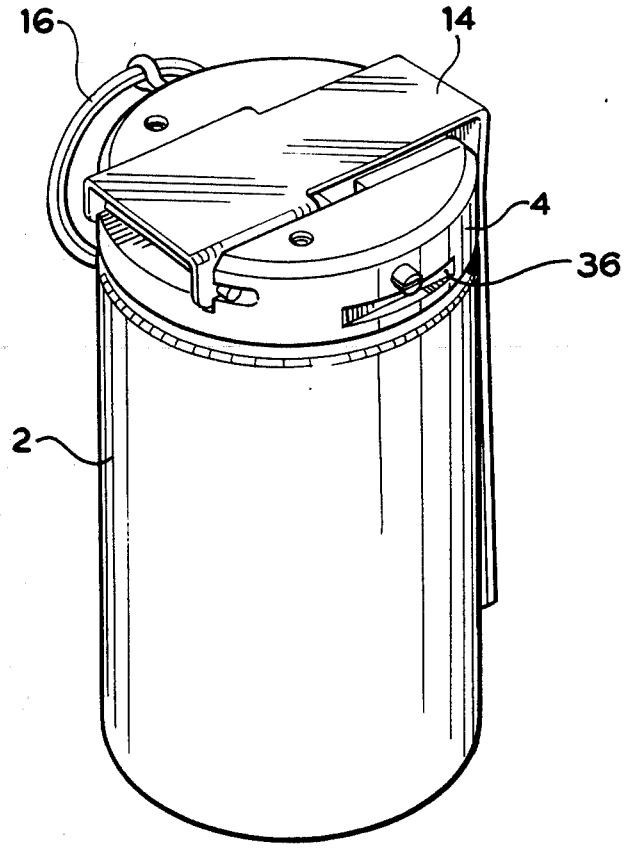
FIG. 3 is a perspective view corresponding to FIG. 1 of the complete grenade.

The grenade comprises a body 2 in the form of a can, e.g. of aluminium, into the open end of which is fitted a headpiece 4 containing the electrical timing and initiation system. The body 2 contains a charge 6 of a pyrotechnic composition into which exends an electric fuzehead 8 (e.g. type K fuzehead manufactured by ICI (Nobel) Ltd), which can ignite the charge when activated electrically. The fuzehead 8 extends from the head-piece 4, which is sealed in the end of the body 2 by a resilient O-ring 10. The can 2 is held on to the head-piece 4 by pressing the upper rim of the can into a circumferential groove 12 in the head-piece.

The head-piece 4 has pivotally mounted thereon an operating handle or lever 14 which, in the "safe" position, lies along the body 2. The lever 14 is held in the "safe" position by means of a safety pin 16 which passes through the head-piece 4 and through a hole in a side flange of the lever 14 within the head-piece.

Figure 4:
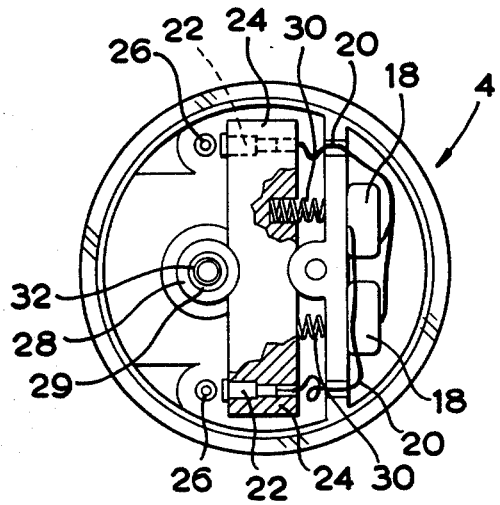
FIG. 4 is an underneath plan view of the head-piece shown in FIGS. 1 and 2, with the circuit-board removed.

The head-piece 4 contains a pair of electric cells 18, connected in series and sealed into a solid plastics composition. Wires 20 (FIGS. 4 and 5) connect the cells 18 to two spaced terminals 22 mounted in a slidable block 24. The block 24 is held so that the terminals 22 are spaced from two corresponding terminal posts 26 fixed in the head-piece, by a camming plug 28, and springs 30 are provided to bias the block 24 into engagement with the plug 28. The plug 28 is spring-biased upwardly in the head-piece 4 by a spring 32 which locates within a socket 29 in the plug 28 and bears against a circuit board 34 which serves to close the lower face of the head-piece 4. The plug 28 is restrained by the lever 14 against upward movement, and also has an arm 27 which curves back to form a loop through which the pin 16 can pass, further ensuring that no movement can occur until the grenade is armed by removal of the pin.

Figure 5:
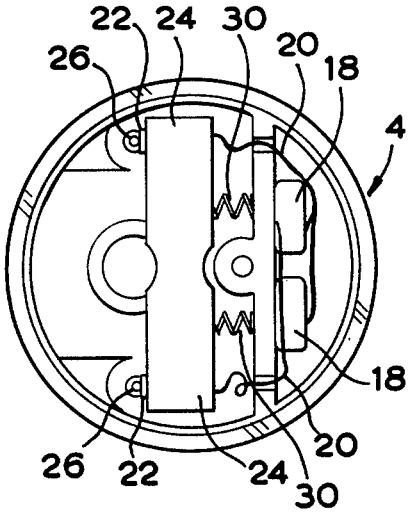
FIG. 5 is the same view as in FIG. 4, but showing the positions of the components at the instant of detonation.

In use, the grenade is armed by removal of the pin 16, but is kept safe by holding the lever 14 engaged against the side of the body 2. On release of the lever, i.e. when the grenade has been thrown, the lever 14 is pivoted outwardly from the head-piece 4 and body 2 by the plug 28 which is in turn forced upwardly in the head-piece by the spring 32. The lower portion of the plug is tapered so as to allow the block 24 to slide as the plug 28 moves upwardly. This permits the terminals 22 to contact the corresponding terminal posts 26. The terminal posts are each soldered to respective parts of the electrical control circuit provided on the circuit board 34, described in more detail hereinafter with reference to FIG. 6, and so engagement of the terminals 22 with the terminal posts 26 completes the electrical connection from the cells 18 to the circuit, which ignites the pyrotechnic charge after an appropriate delay. FIG. 5 shows the components in the position wherein ignition occurs.

The grenade head-piece 4 is provided with an opposed pair of grooves 36 in the sides thereof whereby the grenade may be supported in a trip-stand permitting the grenade to be operated by a trip-wire or the like.

The terminal posts 26 each have a socket 25 opening to the exterior of the head-piece 4, whereby wires may be connected between the circuit and a remote power source and switch for remotely igniting the device. Each wire can be provided with a pin conforming with a socket 25.

The electric cell is suitably of a type retaining a charge for a long period of time, thereby giving the grenade a long "shelf-life" in which it remains usable when stored.

Figure 6:
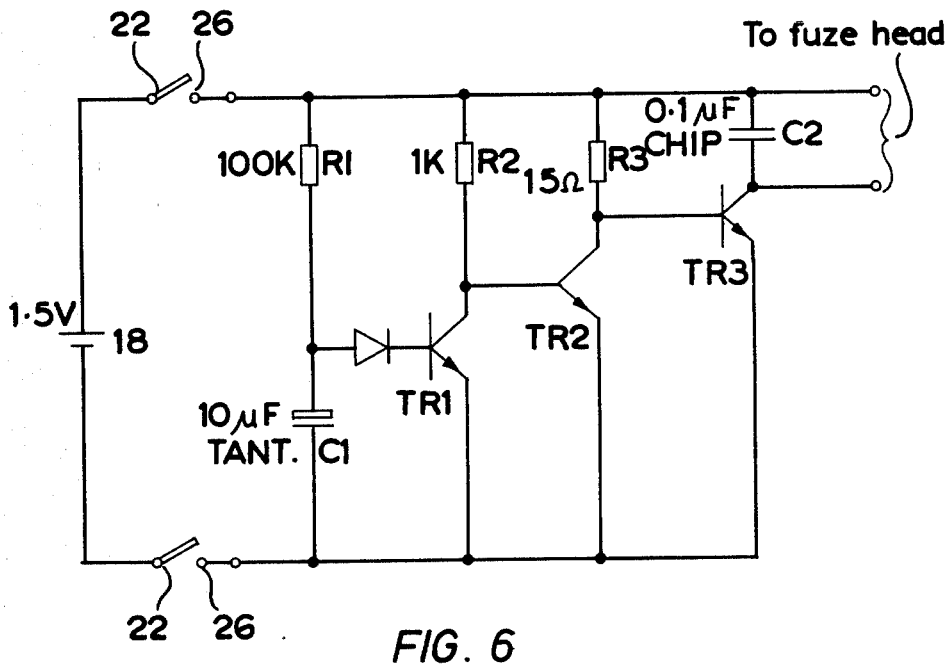
FIG. 6 is an electrical circuit diagram for the grenade illustrated in FIGS. 1 to 5.

Referring to FIG. 6, the electrical circuit includes a first transistor TR1 connected across the two terminals of the circuit via resistor R2, the base potential of the transistor being controlled by a tantalum bead capacitor C1 charged by the cells 18 via resistor R1 when the circuit is closed by release of the lever 14, as hereinbefore described. The capacitor C1 and resistor R1 act as time delay elements, the transistor TR1 only becoming conductive when the capacity C1 has become charged to the required potential on the base of the transistor. This causes the base potential on the second transistor TR2, connected across the two terminals of the circuit via resistor R3, to fall to a level at which the transistor ceases to conduct, which, in turn, causes the base potential of a third transistor TR3 to increase to a level at which the transistor will conduct, so permitting a current to flow in the fuzehead to ignite the charge. A chip capacitor C2 connected across the output terminals to the fuzehead ensures that the device cannot be ignited by stray currents induced in the circuit by, for example, electromagnetic radiations such as radio transmissions.

In an alternative embodiment, fixed resistor R1 is replaced with a variable resistor controllable by an externally-accessible control, whereby the length of the time-delay before ignition may be preselected at the time of use of the device.

The switch being contained within the head-piece 4, any noise emitted by closure of the switch can be damped by surrounding the switch with sound-damping material, permitting the device to be operated substantially inaudibly.

What I claim is:

1. An explosive device including an outer casing containing an explosive charge, an electrical firing circuit and an electrical firing element connected to said electrical firing circuit and positioned to ignite said explosive charge, an electrical energy storage battery positioned within said outer casing, electrical switch means positioned within said outer casing for, in a first normal position, isolating said electrical energy storage battery from said electrical firing circuit and, in a second activated position, connecting said electrical energy storage battery to said electrical firing circuit, a manually engageable operating level for controlling the position of said electrical switch means, pin means for retaining said operating lever in a first position in which said electrical switch means is maintained in its first normal position, spring means for biasing said operating lever to move said operating lever to a second position on removal of said retaining pin means and manual release of said operating lever, in which second position the switch means is switched to its second activated position to fire said explosive charge.

2. A device according to claim 1, in which the electrical firing circuit includes delay means for delaying ignition of the charge for a predetermined period of time after release of the operating lever.

3. A device according to claim 1, wherein the operating lever in its first position is arranged to lie adjacent to the surface of the device.

4. A device according to claim 1, wherein external connections are provided for connecting an external power supply to the firing element.

* * * * *